US005448893A

United States Patent [19]

Howard et al.

[11] Patent Number: 5,448,893

[45] Date of Patent: * Sep. 12, 1995

[54] PROCESS FOR MAXIMIZING THE RECOVERY OF ARGON FROM AN AIR SEPARATION SYSTEM AT HIGH ARGON RECOVERY RATES

[75] Inventors: Henry E. Howard; Dante P. Bonaquist; William M. Canney, Williamsville; William A. Nash, Grand Island, all of N.Y.

[73] Assignee: Praxair Technology, Inc., Danbury, Conn.

[ * ] Notice: The portion of the term of this patent subsequent to May 24, 2011 has been disclaimed.

[21] Appl. No.: 242,391

[22] Filed: May 13, 1994

Related U.S. Application Data

[63] Continuation-in-part of Ser. No. 11,605, Feb. 1, 1993, Pat. No. 5,313,800.

[51] Int. Cl.[6] ..... F25J 3/04

[52] U.S. Cl. ..... 62/22; 62/37; 364/501

[58] Field of Search ..... 62/21, 22, 37; 364/501

[56] References Cited

U.S. PATENT DOCUMENTS

| | | | |
|---|---|---|---|
| 2,934,907 | 5/1960 | Scofield | 62/21 |
| 2,934,908 | 5/1960 | Latimer | 62/22 |
| 3,912,476 | 10/1975 | Mikawa et al. | 62/37 |
| 4,734,114 | 3/1988 | Tasaka et al. | 62/37 |
| 4,784,677 | 11/1988 | Al-Chalabi | 62/37 |
| 4,801,209 | 1/1989 | Wadlow | 356/417 |
| 4,842,625 | 6/1989 | Allam et al. | 62/22 |
| 5,313,800 | 5/1994 | Howard et al. | 62/22 |

*Primary Examiner*—Ronald C. Capossela
*Attorney, Agent, or Firm*—Cornelius F. O'Brien

[57] ABSTRACT

The present invention is a process for maximizing the recovery of argon at high argon recovery rates from an air separation system having a high and low pressure distillation column containing multiple distillation stages of rectification and having a sidearm column for argon recovery. A compositional measurement is made of a process variable at one or more preselected stages of rectification which have been identified as exhibiting high sensitivity to plant process variations. The total nitrogen content in a selected area of the argon sidearm column may then be compensated by simulated mathematical correlation from such compositional measurement.

15 Claims, 4 Drawing Sheets

PROCESS FOR MAXIMIZING THE RECOVERY OF ARGON FROM AN AIR SEPARATION SYSTEM AT HIGH ARGON RECOVERY RATES

This is a continuation-in-part of prior U.S. application Ser. No. 08/011,605 filing date: Feb. 1, 1993.

FIELD OF INVENTION

The present invention relates to a process for maximizing the recovery of argon at high argon recovery rates from a dual pressure cryogenic air separation system having a sidearm column for the recovery of argon.

BACKGROUND OF THE INVENTION

Argon is a component of air that is present at slightly less than 1% mole fraction. Conventional dual pressure processes are employed to separate air at cryogenic temperatures into oxygen and nitrogen. Air is first compressed to approximately 5–6 atm absolute and then subjected to rectification in a high and low pressure distillation column which are thermally linked to one another. The high pressure column operates under superatmospheric pressure corresponding to the pressure of the air feed. The air feed undergoes preliminary separation in the high pressure column into a liquid fraction of crude oxygen and a liquid fraction of substantially pure nitrogen. The two resulting liquids typically form the feed fraction and the rectification reflux for the low pressure distillation operation. Argon is typically recovered through an auxiliary argon sidearm column.

The relative volatilities of nitrogen, argon and oxygen force argon to accumulate in an intermediate stripping section of the low pressure distillation column. An argon enriched gas fraction can be withdrawn from this section to form the feed fraction for the auxiliary or sidearm column which rectifies it. The product vapors exiting the top of the sidearm column form a crude argon stream which is composed primarily of argon, several percent of oxygen and nitrogen in a concentration of typically only 0.005–0.02 mole fraction. An argon condenser supplies the rectification reflux for the sidearm column.

The low pressure column feed is normally the high pressure liquid bottoms. Its composition generally ranges from 34 to 38% oxygen. After partial vaporization in the argon condenser, the kettle liquid is then fed to the low pressure column where the separation is completed, producing a liquid oxygen component collecting in the base of the low pressure column and a gaseous nitrogen component withdrawn from the top of the low pressure column. As an increasing fraction of argon is recovered from the sidearm column the sensitivity of the plant increases to external and internal process flow rate changes and disturbances. Stated otherwise at low argon recovery rates, typically below 10% of the maximum plant recovery rate, argon column sensitivity to process changes is relatively low whereas at high argon recovery rates within 5–10% of the maximum recovery rate for the plant the sensitivity is accentuated and subjects the argon column to a condition where "dumping" may occur. Dumping occurs when the vapor flow up the sidearm column decreases to a point where the gas flow in the sidearm column can no longer support the liquid in the column. A loss of argon recovery is the result of dumping as is the possibility of introducing significant quantities of liquid into the low pressure column which will contaminate the oxygen purity of the low pressure column for a significant period of time. Dumping is therefore a costly economic penalty of the operation at high argon recovery rates. This can always be avoided by purposely recovering sub-optimal levels of argon at recovery rates below 5–10% of the maximum recovery rate which is equivalent to operating at below 75–85% of capacity depending on the plant. However since argon is a highly valued component of air the reduction of argon column product flow is undesirable from an economic standpoint.

High argon recovery levels are normally accompanied by an increase in the nitrogen content of the argon column feed. Accordingly, the maintenance of desirable levels of nitrogen in the feed to the sidearm column is a fundamental problem in the recovery of argon. If there is inadequate control of the nitrogen in the feed to the sidearm column at high argon recovery levels, dumping, as explained earlier, may occur resulting in a loss in argon recovery and in the potential introduction of significant quantities of liquid into the upper low pressure column. Additionally, the argon column will have to be reinventoried. This will also result in the production of off specification material.

The problem of sustaining high argon recoveries has been addressed in the prior art by attempts to control the nitrogen in the argon make. Typically, the nitrogen content in the argon make is of the order of 0.005–0.02 mole fraction and is accordingly measured indirectly by the difference from the concentration measurements of argon and oxygen. The side arm column typically has a large number of rectification stages which results in large liquid holdups within the column and consequently a large apparent deadtime. The large apparent deadtime of the argon column causes the dynamics of the column to act sluggishly or even unstable. The slow dynamics of the column operation limits the effectiveness of any control scheme dependent upon monitoring nitrogen in the argon make. Another method of control is disclosed in U.S. Pat. No. 4,784,677 which is based upon making a direct measurement of the nitrogen content in the argon column feed using a nitrogen analyzer capable of a real time measurement. The patent further teaches a control arrangement based upon using a waste $O_2$ content measurement from the upper column in conjunction with the real time nitrogen measurement to manipulate the flow of high purity liquid nitrogen reflux to the top of the upper column. The details of the nitrogen analyzer per se is described in U.S. Pat. No. 4,801,209. Since the concentration of nitrogen in the argon column feed is only in parts per million a control methodology dependent upon the accuracy of making real time measurements of variations in nitrogen at this concentration level is not reliable.

SUMMARY OF THE INVENTION

It has been discovered in accordance with the present invention that the nitrogen composition in the upper column between the kettle feed point and the argon column draw can be directly related to the corresponding nitrogen composition at any point in the argon separation. It has further been found that within this region between the kettle feed point and the argon column draw the stages of rectification exhibit the highest sensitivity to changes in process conditions regardless of their nature i.e. be it a disturbance or a manipulated flow change with the degree of sensitivity varying from stage to stage. The degree of sensitivity in each stage is more acute at high argon recovery rates. This sensitivity can be detected by a compositional measurement of e.g. the temperature at each stage of rectification. By selecting one or more stages of rectification which exhibit a high sensitivity to change in process conditions the nitrogen content in each of the selected stages and the total nitrogen content in the argon feed can be derived by simulated mathematical correlation with the compositional measurements.

Broadly, argon is recovered in accordance with the present invention, at high argon recovery rates, from an air separation system having a high and low pressure distillation column containing multiple distillation stages of rectification with the high pressure column providing a nitrogen rich reflux fluid to wash the rising vapors in the low pressure distillation column and having a separate sidearm column for said argon recovery, by a process comprising the steps of:

- introducing an oxygen enriched fluid into said low pressure column at a feed point where comparable oxygen-nitrogen equilibrium exists;
- withdrawing a fluid feedstream from said low pressure column at a location where the argon content is relatively high for use as an input feedstream to said argon sidearm column;
- identifying each stage of rectification within said low pressure column between said feedstream location and said feed point which exhibits a relatively high sensitivity to process changes in said air separation system;
- selecting at least one of said identified stages of rectification which exhibits high sensitivity to process changes for monitoring the composition of said input feedstream to said argon sidearm column;
- formulating a model defining the relationship between the nitrogen content in said feedstream and a compositional variable in said low pressure column at said selected stage of rectification;
- measuring said compositional variable at each selected stage of rectification;
- computing the concentration of nitrogen in said input feedstream to said argon sidearm column from said model in accordance with the value of said measured compositional variable; and
- controlling the operation of said process in response to said computation of nitrogen in said input feedstream.

DETAILED DESCRIPTION OF THE INVENTION

The present invention relates to a process for recovering argon at high argon recovery rates from a cryogenic air separation plant using a conventional high and low pressure distillation column arrangement and an argon sidearm column. Each of the distillation columns contain multiple rectification stages formed from customary distillation trays such as perforated plates or structured packing.

Figure 1:
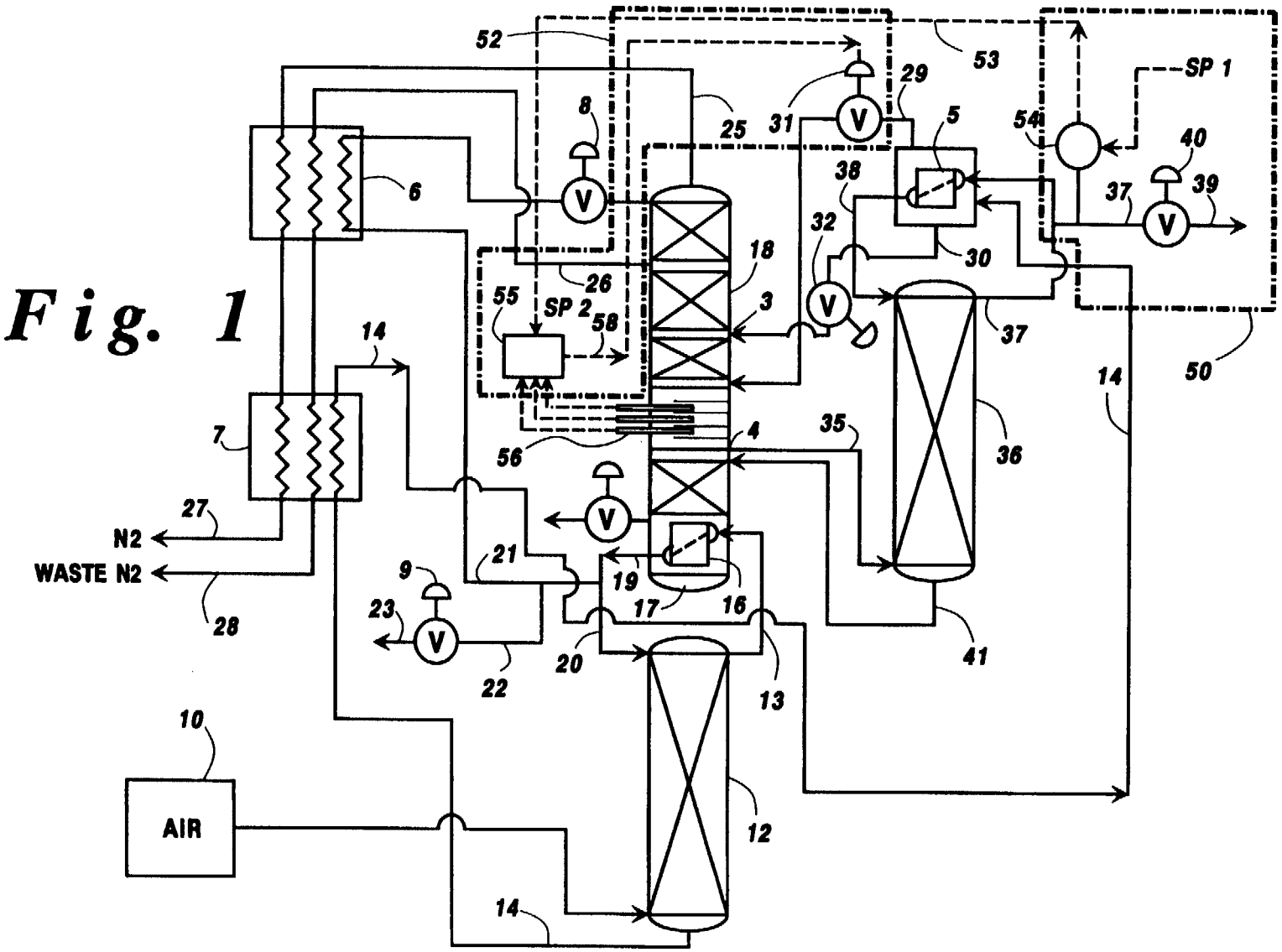
FIG. 1 is a schematic diagram of an air separation plant with three distillation columns for producing an oxygen fraction, a nitrogen fraction and an argon fraction with an appropriate control loop for carrying out the process of the present invention.

With reference to FIG. 1 a source of compressed air 10 which has been cooled and cleaned of contaminants, such as carbon dioxide and water, is fed into the bottom of the high pressure column 12 at a temperature close to its dewpoint. The source of air 10 is subjected to rectification in the high pressure column 12 to form a crude oxygen rich liquid fraction 14 which accumulates at the bottom of the high pressure column 12 and a substantially pure nitrogen vapor fraction 13 at the top of the high pressure column 12. The nitrogen vapor fraction 13 is fed into heat exchanger 16 which reboils the liquid bottoms 17 in the low pressure column 18 via latent heat transfer for forming a condensed stream of liquid nitrogen 19 which is divided into three liquid nitrogen streams 20, 21 and 22 respectively. The first liquid nitrogen stream 20 is used to reflux the high pressure column 12, the second liquid nitrogen stream 21 is subcooled in heat exchanger 6 and subsequently passed through a flow regulator 8 into the low pressure column 18 to serve as reflux for gas separation. The third liquid nitrogen stream 22 is retrieved, through a pressure reducer 9, as a liquid nitrogen product stream 23. Nitrogen is withdrawn from the low pressure column 18 as a vapor stream 25 and 26 and passed through the heat exchangers 6 and 7 to form a nitrogen product stream 27 and a nitrogen waste stream 28 respectively.

The oxygen enriched liquid bottoms stream 14 from the high pressure column 12 is subcooled in heat exchanger 7 and subsequently introduced into latent heat exchanger 5 where it is partially vaporized against condensing crude argon into a vapor stream 29 and a liquid stream 30. Each stream 29 and 30 is passed through a valve 31 and 32 and fed into the low pressure column 18 as one or two separate streams. The liquid stream 30 is generally referred to as the "kettle feed" and it is introduced into the low pressure column 18 at an input location 3 where substantial or effective equilibrium of oxygen and nitrogen exists. It should however be understood that the liquid stream 30 need not be formed from the high pressure column 12 and in fact any number of liquids can be used, for example, oxygen and air. A gaseous stream 35 is withdrawn from the low pressure column 18 at a withdrawal point 4 where the argon concentration is relatively high. This stream 35, referred to hereafter as the "argon feed", consists primarily of argon and oxygen with a trace of nitrogen and has a typical composition range of from 5–25% argon and consequently 95–75% oxygen and a trace of nitrogen. The argon feed 35 is introduced into the bottom of the argon side arm column 36. A stream of argon vapor 37 evolves at the top of the low pressure side arm column 36 and is condensed against the high pressure bottoms stream 14 in the latent heat exchanger 5 to form a stream 38 which serves as reflux for the side arm column 36. A fraction of the crude argon stream 37 withdrawn from the side arm column 36 is reduced in pressure through valve 40 and discharged as the argon product stream 39.

The composition of the argon product stream 39 can vary between 80–99% argon, balance oxygen and nitrogen. The liquid bottoms of the low pressure argon side arm column 36 is substantially reduced in argon content and is returned to the low pressure column 18 as an intermediate liquid feed 41 at approximately the same point 4 or just below the location where the feed stream 35 is withdrawn.

In accordance with the present invention the nitrogen concentration in the argon feed 35 or argon column 36 is derived by taking a compositional measurement, preferably of temperature, at one or more of the stages of rectification in a region of the low pressure column 18 between the kettle feed input location 3 and the withdrawal point 4 for the argon feed 35. This region of the upper column 18 has been found to have a high sensitivity to disturbances and plant changes and is hereafter referred to as "the region of maximum sensitivity". Such sensitivity is used to obtain an indirect measure of the variations in the nitrogen content in the argon column feed 35 as well as the nitrogen content in the argon column 36.

Figure 2:
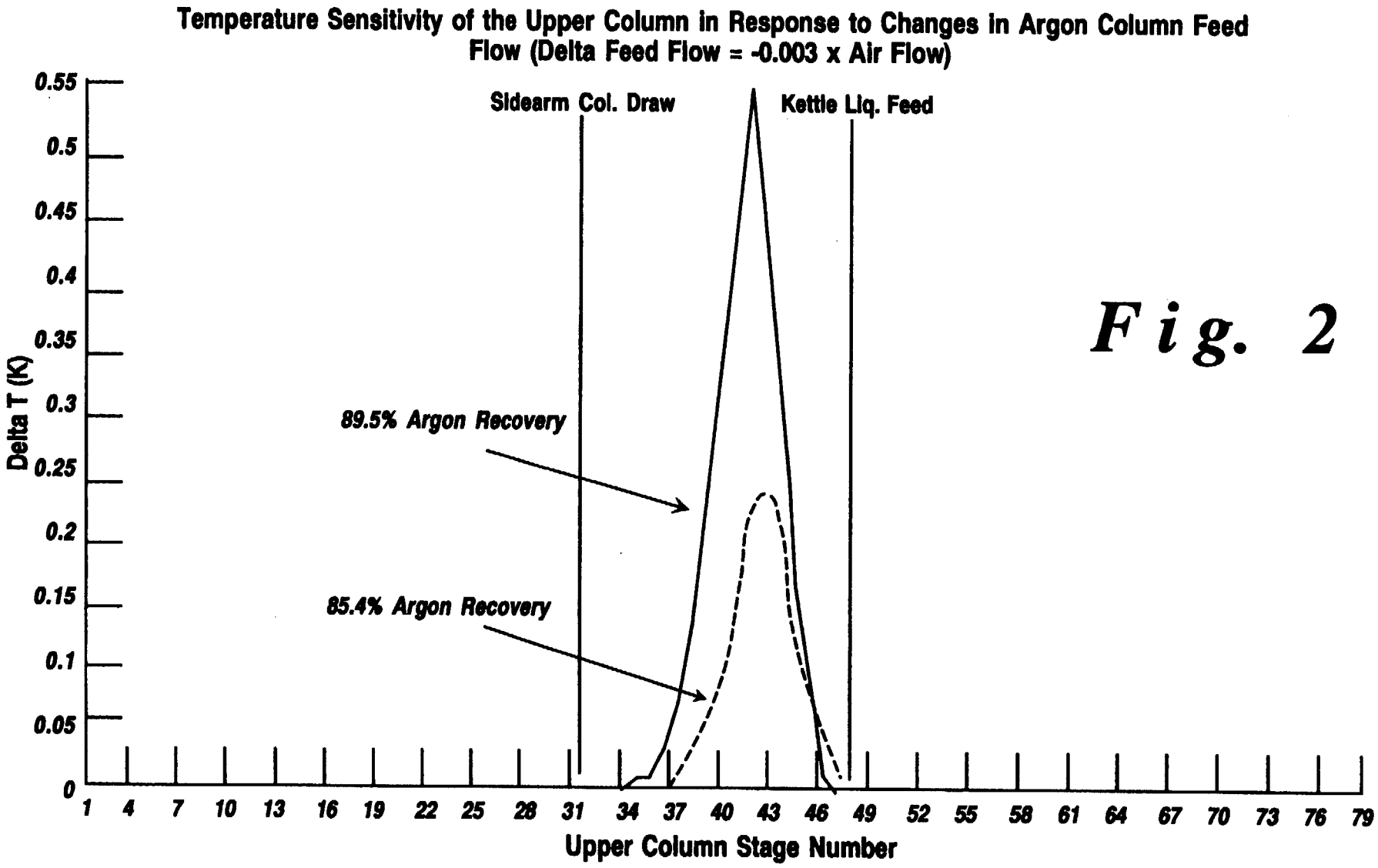
FIG. 2 is a graph showing the sensitivity of each of the multiple stages of rectification in the low pressure column to temperature variations in response to changes in argon column feed flow at two different argon recovery rates.

The degree of sensitivity to plant disturbances within the above identified region of maximum sensitivity relative to all of the other stages of rectification is demonstrated in FIG. 2. In FIG. 2 temperature sensitivity in each of the stages of the upper column 18 is demonstrated in response to changes in flow of the argon feed 35 to the argon side arm column 36. The upper column 18 in the system of FIG. 1 includes 79 stages of rectification with stages 32 to 48 representing the above identified region of maximum sensitivity. As is evident from FIG. 2 the sensitivity is more acute as the level of argon recovery is increased from an argon recovery rate of 85.4% to an argon recovery rate of 89.5%. The peak of maximum sensitivity is experienced in the stage or stages of rectification substantially intermediate the above identified region and shifts somewhat between the stages at different argon recovery rates. A disturbance in the upper column 18 may be accurately described as a nitrogen front or pulse descending the column resulting from a deviation or disturbance in flow of, for example, the argon column feed 35. This disturbance will immediately affect the compositional makeup in the stages within the above described region of maximum sensitivity in a direct relationship. Thus by monitoring the compositional makeup of the bed within the upper column 18 in the region of maximum sensitivity the effect of the disturbance can be monitored with the variation in compositional makeup used to compute the nitrogen content in the argon feed 35. The operation of the process may be controlled in response to the computation of the nitrogen content using any number of control techniques of which a number of examples will hereafter be discussed in greater detail.

Temperature is the preferred means, in accordance with the present invention, for taking a direct or indirect compositional measurement from which the nitrogen content can be computed. If conventional tray technology is used temperature measurements can be retrieved from any point on the tray where a representative measurement of the fluid can be obtained. For instance, the active area of the tray where liquid/gas mass transfer occurs or the tray downcomer are representative examples where temperature measurements may be taken. If structured column packing is used, any means for obtaining a representative measurement in a section can be utilized such as for example at the location where the pool of liquid rests upon a liquid redistributor. Any conventional device may be used to retrieve a temperature measurement including, for example, a conventional thermocouple, vapor pressure thermometer or more preferably a resistance temperature device (RTD). The temperature measurement can also be referenced against any other direct or indirect measurement of composition. For all of the above reasons temperature measurement is obviously preferred over any other compositional measurement. Nevertheless, it is clearly within the scope of the present invention to make other compositional measurements such as pressure, flow or direct gas interbed measurement, using, for example, gas chromatography and mass spectrophotometry to determine the nitrogen content.

Once a compositional measurement is taken, the nitrogen content is computed from a correlation defining the relationship between nitrogen content in the argon feed stream 35 and the compositional measurement. This is established by formulating a mathematical model which will yield the nitrogen concentration through estimation techniques. The mathematical model may be formulated by non-linear thermodynamic simulation or by actual plant data. The actual plant data may represent liquid samples taken at sensitive tray locations within the upper column 18 to provide the compositional measurement. A preferred method for computing the nitrogen content in each stage of rectification from the compositional measurement is by use of linear and/or non-linear regression techniques. Representative examples of other techniques of correlation include the use of the Dynamic Kalman-Bucy Filter, Static Brosilow Inferential Estimator and the principle component regression estimator. The estimated result is indicative of the nitrogen content in the argon feed stream 35. Since there is a direct correlation between the nitrogen content in the argon column feed stream 35 and the nitrogen content in the argon column 36, in principle, controlling the nitrogen content in the argon feed stream 35 is equivalent to controlling the nitrogen content in the argon column 36. Accordingly, one need only make a single compositional measurement at one or more of the highly sensitive stages of rectification to control the nitrogen content in the argon column feed 35 to effect control over the nitrogen content in the argon column 36. Although reference is made to a compositional measurement of a single stage of rectification it is preferred to make two or more measurements at stages of rectification anywhere within the above described region of maximum sensitivity with the number of stages and spacings between stages selected to achieve at least 50% and preferably over 80% of the response of the most sensitive stage location.

If temperature is used as the compositional variable to be measured at each of the selected stages of rectification, the concentration of nitrogen may be derived from a formulated or model relationship using data generated from steady state simulations or actual plant operating data. The basic form of the mathematical expression defining the model relationship to be used in the computer simulations to compute total nitrogen content in the argon feed stream 35 would be as follows: $Y_n = -(a)T_1 + (b)T_2 + (c)T_3 +$ etc.—where $Y_n$ is the computed total content of nitrogen in the argon feed 35 and (a),(b) and (c) etc. are the derived coefficients of the stage temperatures T. Multiple linear regression may be used to determine the coefficients which will yield minimum error. Linear and non-linear regression techniques are well known and many computer programs are conventionally available to perform multiple linear regression. It should be noted that the above coefficients (a), (b) and (c) etc. are weighted values in computing the nitrogen content by summation.

FIG. 1 includes a schematic illustration of an embodiment of a preferred control arrangement for controlling the operation of the air separation process based upon taking a compositional measurement at selected stages of rectification in the upper column 18 to maximize the recovery of argon. The control arrangement includes a master control loop 50 and a slave control loop 52. The master control loop 50 includes a conventional analyzer/controller 54 for taking a measurement of the difference between the nitrogen content in the argon make 37 and comparing it to a setpoint 1 representative of the desired level of nitrogen in the argon make 37 for generating a control signal 53. The control signal 53 may be an hydraulic or electrical signal and may be transmitted from the master control loop 50 to the slave control loop 52 using any conventional signal transmitting means for the appropriate type of control signal 53. It should be noted that depending upon further product argon purity controls present within the system it may not be necessary to utilize the information from analyzer/controller 54. The slave control loop 52 can be operated with equal effectiveness depending upon the accuracy of the relationship of the derived compositional measurement to the nitrogen content in the argon product flow in which instance the master control loop 50 may then be eliminated.

The slave control loop 52 is used to control the nitrogen content in the argon column 36 in response to the control signal 53 received from the master control loop 50. The slave control loop 52 includes a controller 55 and at least one compositional sensing devices 56. The sensing devices 56 may represent a temperature sensing device such as a thermocouple for making a temperature measurement at the selected stages of rectification in the upper column 18 as explained earlier in the specification whereas the controller 55 would include a conventional computer (not shown) for estimating the nitrogen content in the argon feed stream 35 from the compositional measurements taken from the sensing devices 55 in accordance with the principles of the invention as explained in detail earlier in the specification. The measurement locations should preferably be selected to achieve maximum sensitivity to process changes with the column system operating within 10%, and optimally within 5%, of the highest possible argon recovery. The controller 55 would also include conventional comparison means (not shown) for comparing the estimated nitrogen content in the argon feed stream 35 with the control signal 53 to form an output control 58 for adjusting valve 31 in response to the difference. Valve 31 controls the boiling pressure of the kettle liquid and accordingly the argon column feed rate. This is evident from the fact that any adjustment of the valve 31 changes the rate of argon vapor condensation and as such varies the feed rate to the argon column in a direct relationship.

Alternatively the slave control loop 52 can be operated independent of any master control loop 50 in which instance the control signal 53 may be manually set into the controller 55 as setpoint 2. In addition, the controllers 54 and 55 may be arranged to provide any combination of feedforward or feedback algorithm. For example, they may possess any conventional combination of proportional integral or derivative control action to effect their output.

Figure 3:
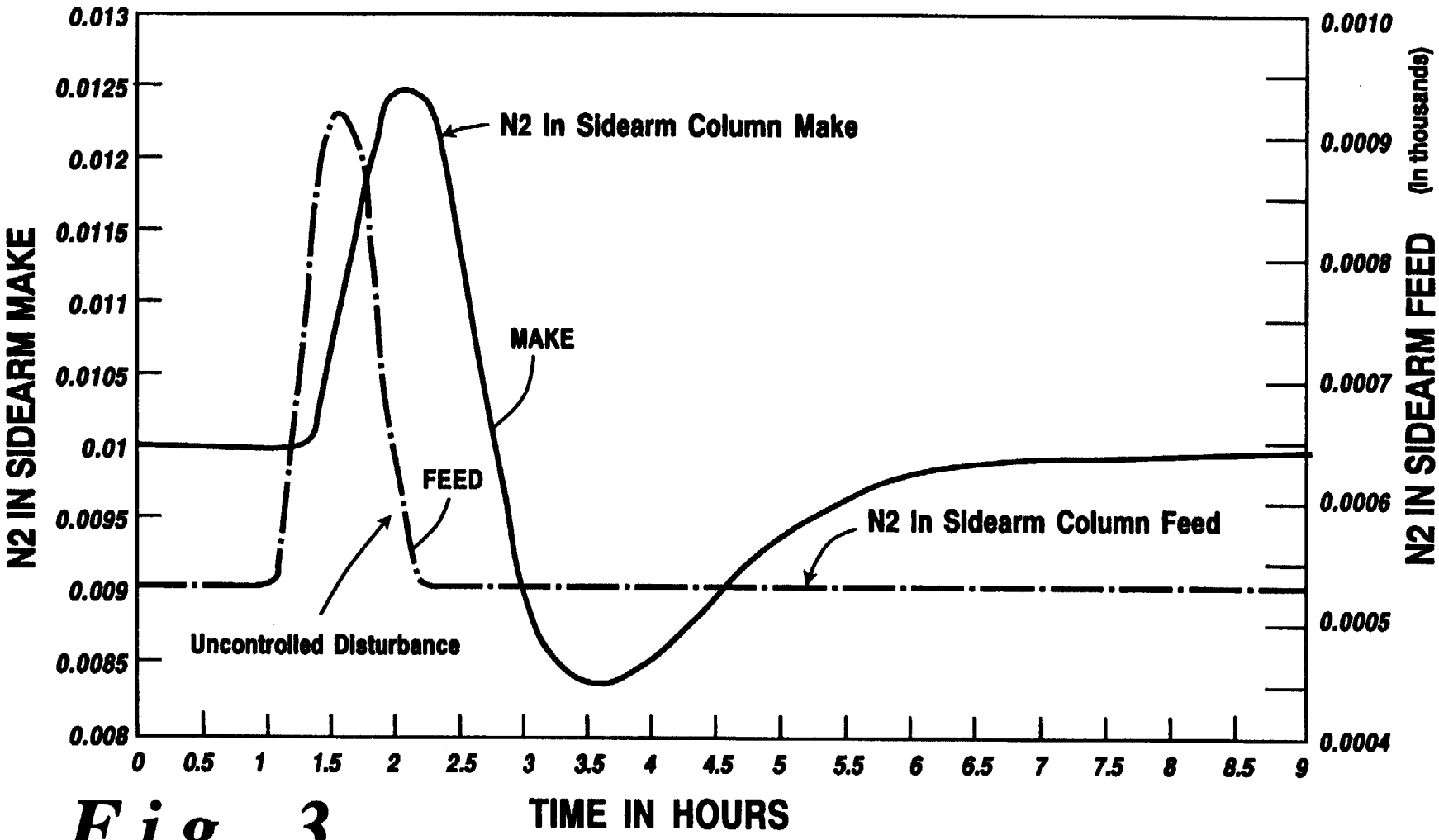
FIG. 3 is a graph showing the effect of an uncontrolled nitrogen excursion into the argon column compared to a simulated controlled excursion in accordance with the present invention.

The air separation system of FIG. 1 was tested using the master slave control loop arrangement discussed above to provide a comparison of a controlled response to a compositional disturbance with an uncontrolled disturbance. This is shown in FIG. 3. The controller 55 employed a linear regression algorithm using three temperature measurements in accordance with the mathematical expression referred to earlier in the specification. These temperature measurements were located at intervals within the section of maximum sensitivity of the upper column 18 below the kettle feed point 3 and above the argon column draw point 4 to achieve maximum sensitivity to process changes with the column system operating within 5% of the highest possible argon recovery. The measurements were located with spacings sufficient to achieve at least 80% of the response of the most sensitive location. FIG. 3 shows two graphs the first of which, as shown by dotted lines, represents an uncontrolled transient disturbance in nitrogen content in the argon column feed. The second graph, as indicated by a solid line, shows a simulated response in the argon make nitrogen content to the same disturbance using the control method of the present invention with the control configuration depicted in FIG. 1. If no control was employed the maximum nitrogen content in the product make in response to the disturbance would have been 0.0173 mole fraction as compared to 0.0125 mole fraction with the controlled action of the present invention.

Figure 4:
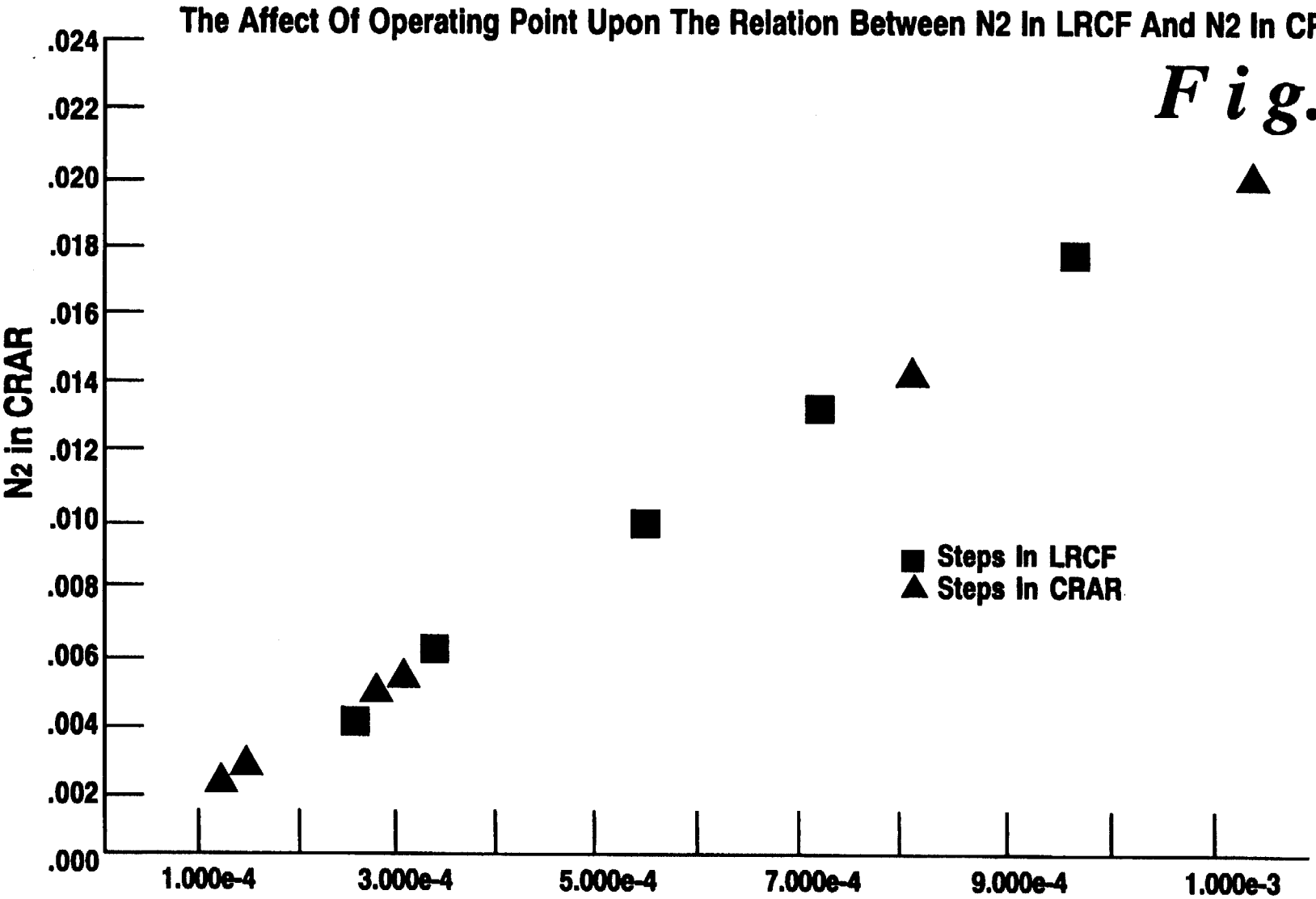
FIG. 4 is a graph showing the effect of operating point upon the relationship between nitrogen in the feedstream ($N_2$ in LRCF) and nitrogen in the crude argon column region ($N_2$ in CRAR).

Although the model is defined in the above embodiment as the relationship between the nitrogen content in the feedstream and a compositional variable in the low pressure column, it is also possible to have the relationship between the nitrogen content in any area throughout the argon column. Specifically, the high relative volatility of nitrogen/(argon or oxygen) binaries relative to the oxygen/argon binary forces nearly all of the nitrogen fed to the base of the argon column to be ultimately recovered from the top of the argon column within the crude argon. Therefore, the model can be defined as the relationship between the nitrogen content at any area in the argon column and not just the feedstream or at the base of the argon column. FIG. 4 shows the typical effect of the operating point of the system upon the relationship of nitrogen in the feedstream or lower rate column feed ($N_2$ in LRCF) and nitrogen in the crude argon column region ($N_2$ in CRAR). This relationship is linear and thereby confirms that the nitrogen at the base of the argon column will eventually be forced to the top of the argon column within the crude argon so that nitrogen can be measured anywhere in the argon column.

In another embodiment of the invention, it will not be necessary to formulate a model and instead, a setpoint can be determined to represent a compositional variable at a specific area or location within the low pressure column. Specifically, based on experience from previous operation conditions of an argon recovery system, a compositional variable such as nitrogen, temperature, nitrogen, oxygen or argon, at the low pressure column can be determined to produce a specific argon recovery rate at the argon make 37 of FIG. 1. Once this setpoint is determined, then a direct measurement of the compositional variable at this specific area in the low pressure column can be compared with the predetermined setpoint and any deviation can be used to produce a signal which can be used to control the operation of the system by adjusting one or more of the feedrates or temperatures of the system until the setpoint compositional value is equal to the measured composition valve. In this embodiment a process is provided producing an improved control of an air separation system having a high and low pressure distillation column containing multiple stages of rectification with the high pressure column providing a nitrogen rich reflux fluid to wash the rising vapors in the low pressure distillation column and having a separate sidearm column for argon recovery which comprises the steps of:

introducing an oxygen enriched fluid into said low pressure column at a feed point where comparable oxygen-nitrogen equilibrium exists;

withdrawing a fluid feedstream from said low pressure column at a location where the argon content is relatively high for use as an input feedstream to said argon sidearm column;

identifying each stage of rectification within said low pressure column which exhibits a relatively high sensitivity to process changes in said air separation system;

selecting at least one of said identified stages of rectification which exhibits high sensitivity to process changes for improved control of said air separation system;

measuring the compositional variable at said selected stage of rectification;

comparing said compositional variable with a predetermined setpoint variable for producing a desired argon recovery; and controlling the operation of said process in response to any difference of said compositional variable with the setpoint variable.

As stated above, the compositional variable could be temperature, nitrogen, oxygen or argon content and the means to control the process to provide a desired argon recovery being oxygen flow rate, air flow rate, sidearms column feed flow rate and sidearm column make flow rate.

It is understood that modifications and changes to the preferred embodiments of the invention herein described can be made without departing from the spirit and scope of the invention as defined in the appendix claims.

What we claim is:

1. A process for improved control of an air separation system having a high and low pressure distillation column containing multiple distillation stages of rectification with the high pressure column providing a nitrogen rich reflux fluid to wash the rising vapors in the low pressure distillation column and having a separate sidearm column for argon recovery comprising the steps of:

introducing an oxygen enriched fluid into said low pressure column at a feed point where comparable oxygen-nitrogen equilibrium exists;

withdrawing a fluid feedstream from said low pressure column at a location where the argon content is relatively high for use as an input feedstream to said argon sidearm column;

identifying each stage of rectification within said low pressure column which exhibits a relatively high sensitivity to process changes in said air separation system;

selecting at least one of said identified stages of rectification which exhibits high sensitivity to process changes for monitoring the composition at a selected area within said argon sidearm column;

formulating a model defining the relationship between the nitrogen content in said selected area within said argon sidearm column and a compositional variable in said low pressure column at said selected stage of rectification;

measuring the compositional variable at said selected stage of rectification;

comparing the concentration of nitrogen in said selected area within said argon sidearm column from said model with the value of said measured compositional variable; and controlling the operation of said process in response to any deviation between said computation of nitrogen in said selected area within said argon sidearm column and said measured compositional variable in said selected area within said argon sidearm column.

2. The process as defined in claim 1 wherein at least two highly sensitive stages of rectification are selected for taking compositional measurements.

3. The process as defined in claim 2 wherein the compositional variable measured at each selected stage of rectification is selected from the group consisting of temperature, nitrogen, oxygen and argon.

4. The process as defined in claim 1 wherein the total nitrogen content in said selected area of said argon sidearm column is computed in accordance with the following mathematical expression: $Y_n=(a)T_i+(b)T_2+(c)T_3+$ etc.—wherein $Y_n$ is the computed total content of nitrogen in the said selected area of said argon sidearm column and (a), (b) and (c) etc. are the coefficients of the stage temperatures at the corresponding a, b, and c etc., stages of rectification.

5. The process as defined in claim 4 wherein the feedstream rate to the argon column is adjusted in response to said computation of nitrogen content in said selected area of said argon sidearm column.

6. The process as defined in claim 5 wherein said computation of nitrogen content at said selected area of said argon sidearm column is compared against a control signal representing a desired nitrogen content at said selected area of said argon sidearm column for generating a control for regulating the flow of oxygen, air, sidearm column feed or sidearm column make.

7. The process as defined in claim 1 wherein the feedstream rate to the argon column is adjusted in response to temperature variations at said selected stages of rectification.

8. The process as defined in claim 1 wherein said model is formulated from thermodynamic data simulation or operating plant data.

9. A process for improved control of air separation system having a high and low pressure distillation column containing multiple distillation stages of rectification with the high pressure column providing a nitrogen rich reflux fluid to wash the rising vapors in the low pressure distillation column and having a separate sidearm column for argon recovery which comprises the steps of:

introducing an oxygen enriched fluid into said low pressure column at a feed point where comparable oxygen-nitrogen equilibrium exists;

withdrawing a fluid feedstream from said low pressure column at a location where the argon content is relatively high for use as an input feedstream to said argon sidearm column;

identifying each stage of rectification within said low pressure which exhibits a relatively high sensitivity to process changes in said air separation system;

selecting at least one of said identified stages of rectification which exhibits high sensitivity to process changes for improved control of said air separation system;

measuring the compositional variable at said selected stage of rectification;

comparing said compositional variable with a predetermined setpoint variable for producing a desired argon recovery, and controlling the operation of said process in response to any difference of said compositional variable with the setpoint variable.

10. The process as defined in claim 9 wherein at least two highly sensitive stages of rectification are selected for taking compositional measurements.

11. The process as defined in claim 10 wherein the compositional variable measured at each selected stage of rectification is selected from the group consisting of temperature, nitrogen, oxygen and argon.

12. The process as defined in claim 9 wherein the total nitrogen content in said selected stage of rectification is determined from the temperature at such stage in accordance with the following mathematical expression: $Y_2=(a)T_i+(C)T_3+$ etc. where $Y_n$ is the computed total content of nitrogen in the selected state and (a), (b) and (c) etc. are the coefficients of the stage temperatures at the corresponding a, b, and c etc. stages of rectification.

13. The process as defined in claim 12 wherein the feed flow rate to the argon column is adjusted in response to said computation of nitrogen content in said selected area of said argon sidearm column.

14. The process as defined in claim 12 wherein the feed flow rate to the argon column is adjusted in response to temperature variations in said selected area of said argon sidearm column.

15. The process as defined in claim 14 wherein said computation of nitrogen content at said selected area in said argon sidearm column determined from the temperature measured at such selected area is compared against a control signal representing a desired nitrogen content at said selected area in said argon sidearm column for generating a control for regulating at lese one of the controls selected from the group consisting of the flow of oxygen, air, sidearm column feed or sidearm column make.

* * * * *